United States Patent [19]

von Dohlen et al.

[11] 3,961,708

[45] June 8, 1976

[54] RETURNABLE BOTTLE PACKING CASE

[75] Inventors: Henry Claus von Dohlen, Dover; Wallace Allison Burt, Morristown, both of N.J.

[73] Assignee: Allied Chemical Corporation, New York, N.Y.

[22] Filed: Dec. 23, 1974

[21] Appl. No.: 535,257

[52] U.S. Cl. ..... 206/435; 206/203; 206/521; 220/338; 220/229; 229/2.5 R; 229/14 C; 229/28 BC; 229/29 M

[51] Int. Cl.[2] ..... B65D 5/48

[58] Field of Search ..... 220/338; 229/2.5 EC, 229/14 C, 29 M, 29 E, 28 BC, 2.5 R; 206/139, 203, 523, 72, 524, 521, 427, 433, 435

[56] References Cited

UNITED STATES PATENTS

| | | | |
|---|---|---|---|
| 2,216,339 | 10/1940 | Reamer | 206/433 |
| 2,569,681 | 10/1951 | Lennon | 229/29 M |
| 2,600,130 | 6/1952 | Schilling | 229/29 M |
| 2,668,652 | 2/1954 | Russell | 229/29 M |
| 2,739,750 | 6/1956 | Cox | 229/29 M |
| 3,294,270 | 12/1966 | Geisler | 206/433 |
| 3,381,873 | 5/1968 | Hirota | 229/2.5 |
| 3,552,595 | 1/1971 | Gerner | 229/2.5 |
| 3,618,287 | 11/1971 | Gobhai et al. | 206/524 |

*Primary Examiner*—William Price
*Assistant Examiner*—Bruce H. Bernstein
*Attorney, Agent, or Firm*—Anthony J. Stewart; Jay P. Friedenson

[57] ABSTRACT

A packaging device for a fragile article which can be stacked in nested relationship with similar packaging devices when not holding such an article. The packaging device comprises a base insert for holding a lower portion of the fragile article, a base for protecting the base insert from impact, a top insert for holding an upper portion of the fragile article and a top for protecting the top insert from impact.

5 Claims, 5 Drawing Figures

Fig. 4.
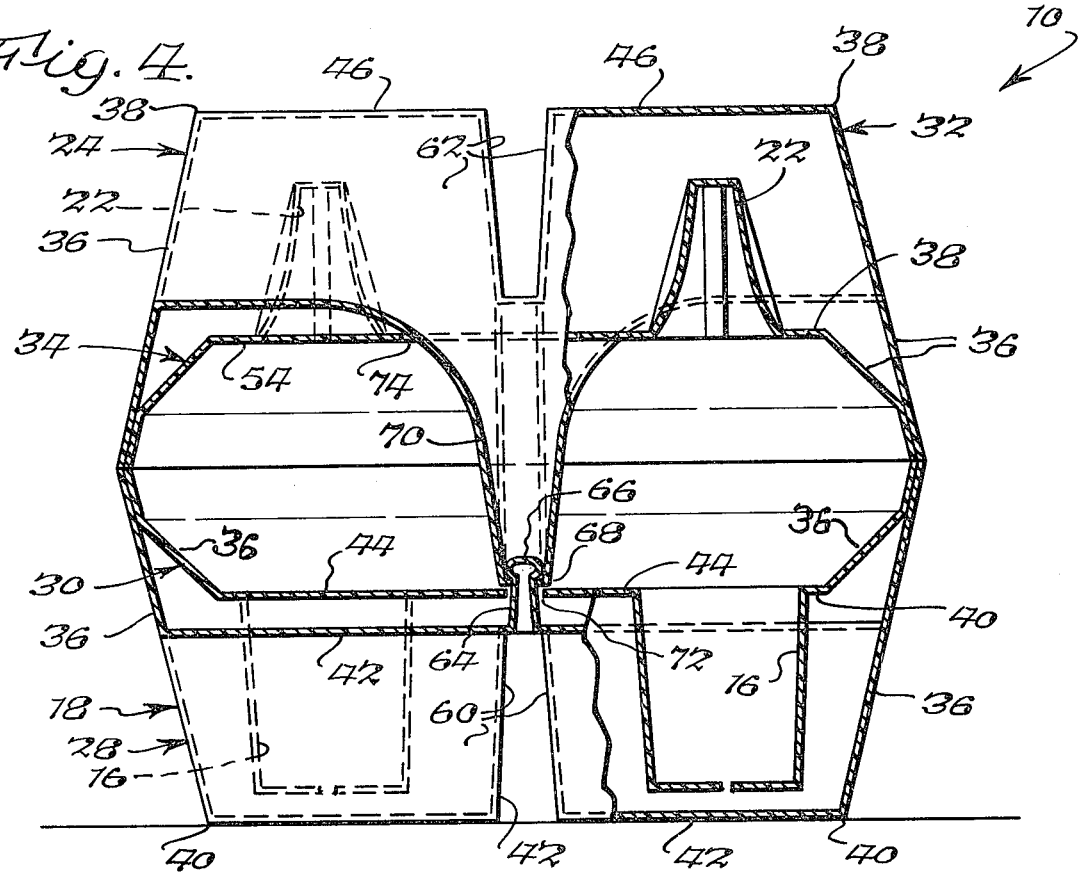
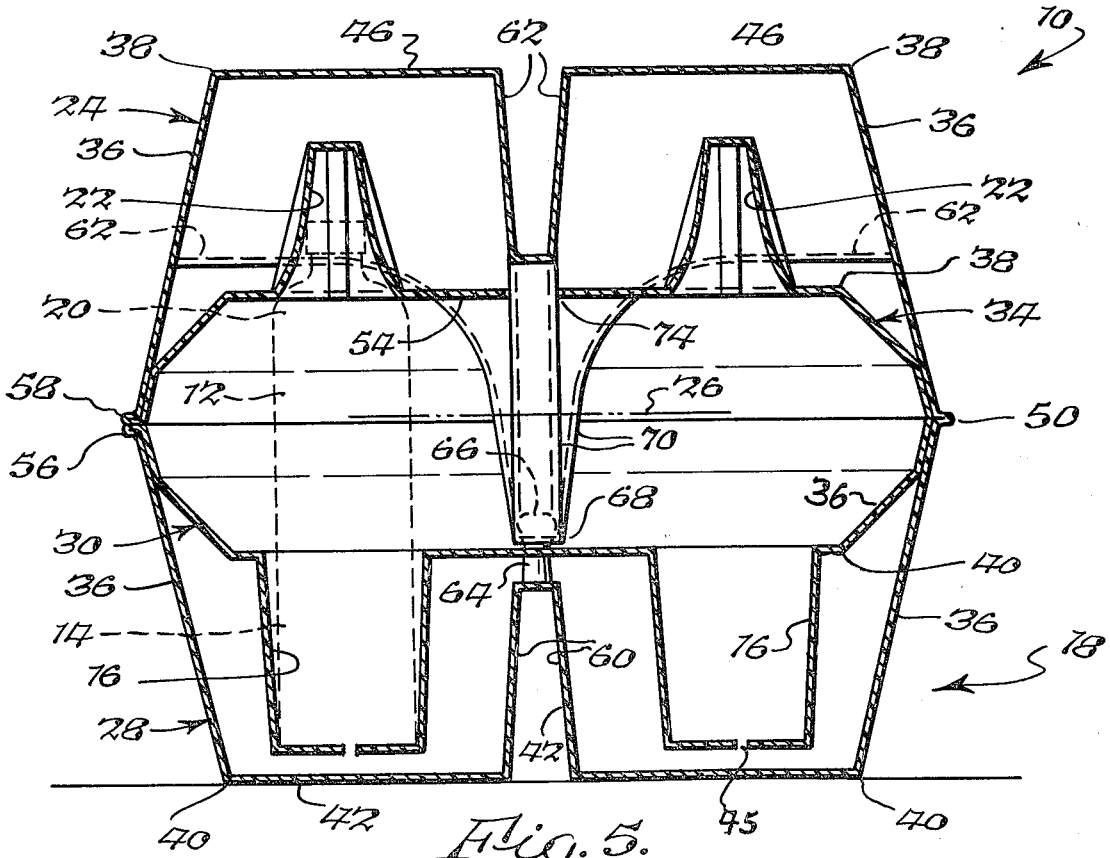
Fig. 5.

RETURNABLE BOTTLE PACKING CASE

BACKGROUND OF THE INVENTION

This invention concerns a packaging device for fragile articles and more particularly concerns a packaging device for containing and protecting bottles or other breakable containers which may contain corrosive or toxic substances.

HISTORY OF THE PRIOR ART

In the prior art, packaging devices for fragile articles and particularly packaging devices for holding breakable containers such as bottles either were not sufficiently impact resistant to protect bottles containing corrosive or toxic substances or else were manufactured from expensive and bulky foam materials such as expanded polystyrene.

Packaging devices for fragile articles manufactured from foam materials were frequently difficult to manufacture since precise control over temperature and chemical composition is required to obtain a consistent foam product and since the finished packaging device manufactured from plastic foam is bulky and requires large amounts of storage space, packaging devices manufactured from foam plastic materials are expensive to store and ship.

In addition, due to the large volume required by the foam materials, there was insufficient liquid tight space in packaging devices manufactured from foam materials to provide a secondary emergency container to retain the liquid in a container should the container inadvertently break.

BRIEF DESCRIPTION OF THE DRAWINGS

FIG. 4 is an elevational plan view taken along line 4—4 of FIG. 3; and FIG. 5 is an elevational plan view taken along line 5—5 of FIG. 3.

BRIEF DESCRIPTION OF THE INVENTION

Figure 1:
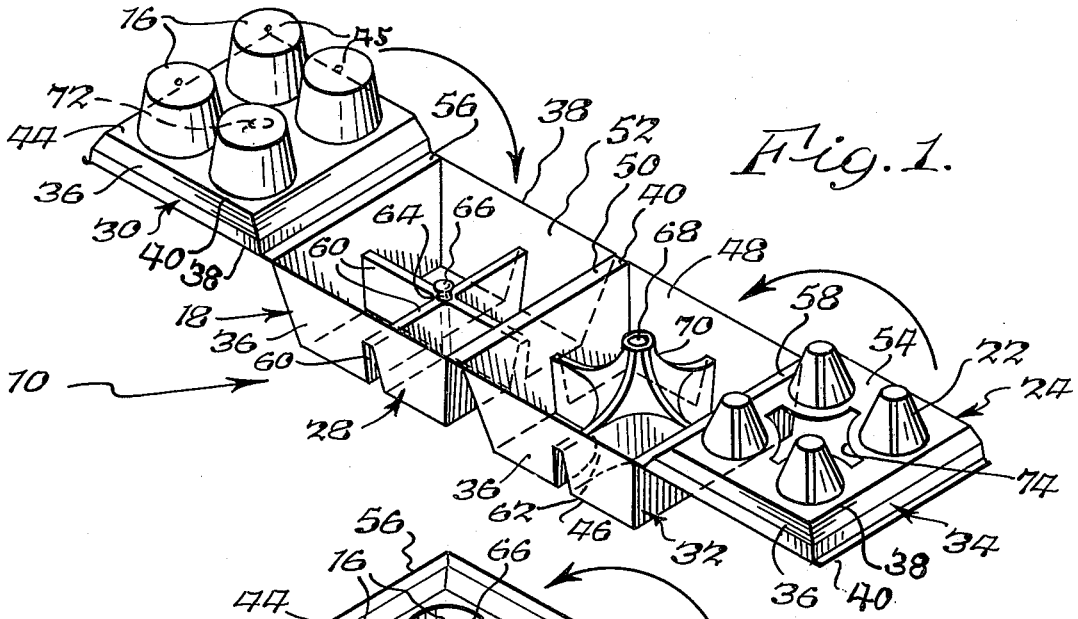
FIG. 1 is a perspective view of the packaging device of the invention showing the device in a nestable position.

In accordance with this invention there is, therefore, provided a novel packaging device which unexpectedly has high impact resistance which permits fragile containers such as bottles to be protected from breakage due to the type of accidents commonly encountered in normal shipping and storage operations, yet is not manufactured from foam materials which are difficult to handle and expensive to use. In addition, the packaging device in accordance with the invention when not holding a fragile article, can be stacked in a nested relationship with similar packaging devices, thereby reducing shipping and storage costs since shipping and storage space is minimized.

The packaging device for one or more fragile articles in accordance with the invention is an integral packaging device comprising a base, a top, a base insert, and a top insert, each of which is individually defined by its own sidewalls, each of the sidewalls having top and bottom edges. The base is further defined by a bottom wall connected to the bottom edges of the sidewalls of the base and the top is further defined by a top wall connected to the top edges of the sidewalls of the top. The bottom edge of one of the sidewalls of the top is hinged to the top edge of one of the sidewalls of the base. The base, as defined by its sidewalls and bottom wall, has a large enough volume to contain liquid which may leak from a fragile container holding such liquid.

The base insert includes a lower wall connected to the sidewalls of the base insert which lower wall is provided with one or more downwardly extending depressions having an interior which is approximately the size of a lower portion of the fragile article for containing the lower portion of the article. The base insert is hinged at the top edge of one of its sidewalls to the top edge of a sidewall of the base other than the top edge of the sidewall of the base which is hinged to the top. The base insert is sized to fit tightly into the base. The downwardly extending depression is provided with at least one hole to permit liquid which may leak from the fragile article to flow into the base, thus preventing such liquid from escaping from the packaging device.

The top insert includes an upper wall connected to the sidewalls of the top insert which upper wall is provided with one or more upwardly extending depressions having approximately the size of an upper portion of the fragile article for containing the upper portion of the article. The top insert is hinged at the bottom edge of one of the sidewalls to the bottom edge of a sidewall of the top other than the bottom edge of the sidewall of the top which is hinged to the base. The top insert is sized to fit tightly into the top.

The packaging device is nestable into a similar packaging device when the upper edges of the sidewalls of the base and base insert and the bottom edges of the top and top insert of the packaging device are in approximately parallel planes, when the base insert is not fitted into the base and when the top insert is not fitted into the top.

DETAILED DESCRIPTION OF THE INVENTION

Figure 2:
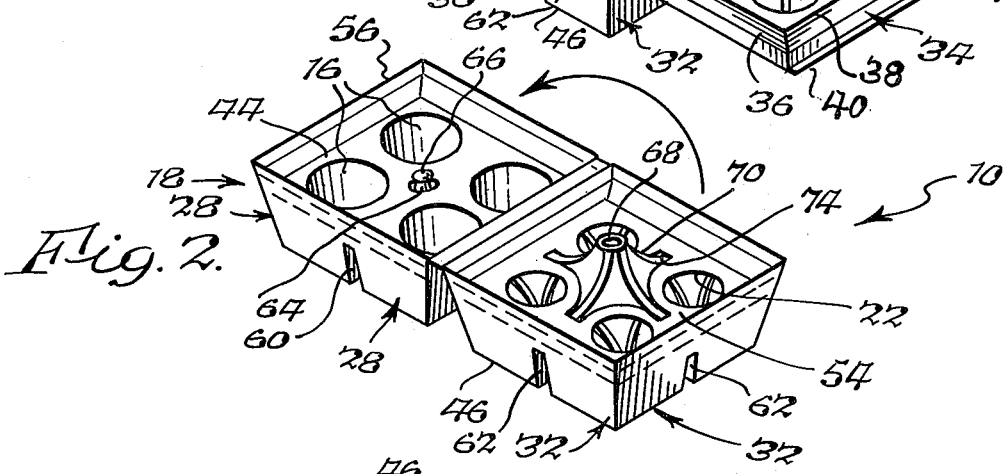
FIG. 2 is a perspective view of the packaging device of the invention wherein the top insert is folded into the top and the base insert is folded into the base.
Figure 3:
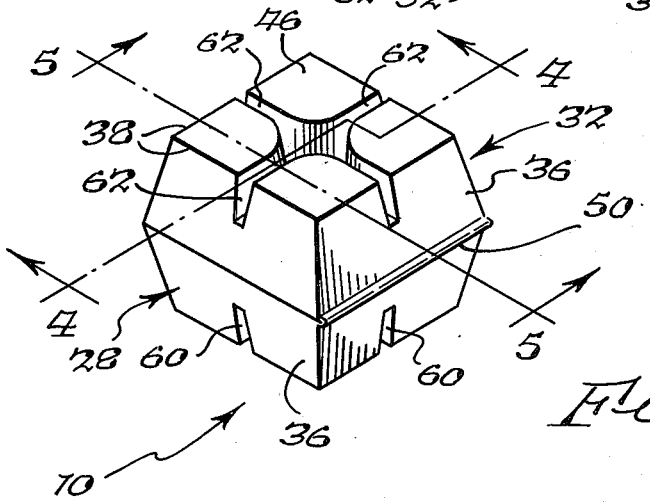
FIG. 3 is a perspective view of the packaging device of the invention showing the cover portion of the device engaged upon the lower portion of the device.

Referring now to the drawings, in accordance with the preferred embodiment of this invention, an integral, i.e., one piece packaging device 10 is provided for a fragile article 12 as best seen in FIG. 5. The packaging device 10 in accordance with this invention may be designed to hold a single fragile article 12 or a plurality of such articles. "Fragile article" as used herein means any article which is subject to fracture or breakage or is otherwise subject to complete or partial destruction when the article is inadvertently dropped, or otherwise collides with an object which will cause breakage or destruction during normal handling operations. In accordance with this invention, the lower portion 14 of fragile article 12 is held and protected within a depression 16 in the bottom 18 of packaging device 10 and the upper portion 20 of the fragile article 12 is held and protected within a depression 22 in a cover portion 24 of packaging device 10. "Upper portion" means a part of the fragile article 12 above the center of gravity 26 of the fragile article 12 and "lower portion" means a part of the article below the center of gravity 26 of the fragile article 12. As best seen in FIGS. 1, 2 and 3, the bottom 18 of the integral packaging device 10 comprises a base 28 and a base insert 30, and cover portion 24 of packaging device 10 comprises a top 32 and a top insert 34. Base 28, top 32, base insert 30 and top insert 34 are each individually defined by their own sidewalls 36. As seen in FIGS. 4 and 5, each of the sidewalls 36 have top edges 38 and bottom edges 40. Base 28 is further defined by a bottom wall 42 connected to the bottom edges 40 of the sidewalls 36 of base 28. Lower wall 44 is connected to the sidewalls 36 of base insert 30 at a position proximate bottom edges 40 of sidewalls 36 of base insert 30. In the preferred embodiment, the volume of base 28, as defined by sidewalls 36 and bottom wall 42, is larger than the volume of fragile article 12. Base insert 30 is sized to fit tightly into base 28 and lower wall 44 of base insert 30 is provided with at least one downwardly extending depression 16 having approximately the size of lower portion 14 of the fragile article 12 for containing such lower portion 14. Downwardly extending depression 16 is preferably provided with a hole 45 connecting the interior of depression 16 with base 28 to permit passage of liquid, which may be held by fragile article 12, into base 28 should article 12 break. "Downwardly extending" as used herein means that depression 16 in lower wall 44 is in a direction away from top 32 when top 32 covers base 28.

Top 32, in addition to being defined by its sidewalls 36, is further defined by a top wall 46 connected to top edges 38 of sidewalls 36 of top 32. As seen in FIGS. 1, 2 and 3, bottom edges 40 of the sidewalls 36 of top 32 define an opening 48 into top 32 and one of bottom edges 40 of top 32 is hinged by means of hinge 50 to a top edge of one of the sidewalls 36 of the base 28 thus permitting top 32 to be rotated about hinge 50 so that the opening 48 into top 32 covers an opening 52 in the base 28 defined by top edges 38 of sidewalls 36 of base 28.

Top insert 34 includes an upper wall 54 connected to sidewalls 36 of top insert 34 proximate top edges 38 of sidewalls 36 of top insert 34. Upper wall 54 is provided with at least one upwardly extending depression 22 having approximately the size of an upper portion 20 of fragile article 12 for containing such upper portion 20. As used herein "upwardly extending depression" means a depression formed in upper wall 54 which extends from upper wall 54 in a direction away from base 28 when top 32 covers base 28.

Base insert 30 is hinged by means of hinge 56 at top edge 38 of one of its sidewalls 36 to top edge 38 of one of the sidewalls of base 28, other than the top edge 38 of the sidewall of base 28 hinged to top 32, thus permitting base insert 30 to be rotated about the hinge 56 so that base insert 30 will fit tightly into opening 52 in base 28. Top insert 34 is similarly hinged by means of hinge 58 at the bottom edge 40 of one of its sidewalls 36 to a bottom edge 40 of a sidewall 36 of top 32, other than the bottom edge of the sidewall of top 32 hinged to base 28, thus permitting top insert 34 to be rotated about hinge 58 so that top insert 34 fits tightly into opening 48 in top 32.

Packaging device 10 is nestable into similar packaging devices when top edges 38 of sidewalls 36 of base 28 and of base insert 30, and the bottom edges 40 of top 38 and of top insert 34 of the packaging device are in approximately parallel planes, base insert 30 is not fitted into base 28 and top insert 34 is not fitted into top 32. No areas are defined by the structure of the packaging device 10 which require large amounts of space since there is no completely enclosed space, i.e., a bulky area defined by the structure of the packaging device 10 when the packaging device 10 is opened, i.e., base insert 30 is not fitted into base 28 and top insert 34 is not fitted into top 32. In addition, all open areas defined by the structure of the packaging device 10, for example, those open areas defined by the sidewalls or depressions, are defined so that the opening into the defined area is larger than any internal cross section of the defined area so that one opened packaging device can be nested into a similar open packaging device, thus the packaging devices can be shipped and stored in a minimal of space.

When base insert 30 is fitted into base 28 by rotating base insert 30 about hinge 56 connecting base insert 30 to base 28 and when top insert 34 is fitted into top 32 by rotating top insert 34 about hinge 58 connecting top insert 34 to top 32, depressions 16 formed in lower wall 44 of base insert 30 are protected by sidewalls 36 and bottom wall 42 of base 28 and the depressions 22 formed in upper wall 54 of top insert 34 are protected by sidewalls 36 and top wall 46 of top 32. When cover 24, including top 32 and top insert 34 is rotated about hinge 50, connecting top 32 with base 28 so that opening 48 is defined by bottom edges 40 of sidewalls 36 of top 38 covers opening 52 defined by top edges 38 of sidewalls 36 of base 28, a depression 22 formed in upper wall 54 of top insert 34 will be located directly above a depression 16 formed in the lower wall 44 of base insert 30 which depressions will securely hold and protect fragile article 12 which depressions and article will be further protected by sidewalls 36 and top wall 46 of top 32 and sidewalls 36 and bottom wall 42 of base 28.

In the preferred embodiment of the invention, the packaging device 10 has a plurality of depressions 22 in the upper wall 54 of top insert 34 which match corresponding depressions 16 in the lower wall 44 of base insert 30 so that a plurality of fragile articles 12 can be stored in a single packaging device. Preferably, the packaging device has four such depressions in the upper wall and four such depressions in the lower wall. Another number of such depressions which is considered convenient is six such depressions in each of the upper and lower walls of the packaging device.

Desirably the base of the packaging device is provided with partitioning means, e.g., internal walls 60, for separating depressions 16 in base insert 30 when base insert 30 is fitted into base 28. Such partitioning means provide additional protection for depressions 16 of base insert 30 which hold a lower portion of the fragile articles. Similarly, it is desirable for top 32 to be provided with a partitioning means e.g. internal walls 62 for separating depressions 22 in top insert 34 to provide additional protection for such depressions when top insert 34 is fitted into top 32.

In order to provide increased impact resistance and cushioning effect so that the fragile articles will not become fractured or otherwise destroyed, depression 16 in base insert 30 is spaced from sidewalls 36 and bottom wall 42 of base 28 so that if base 28 is impacted, base 28 will deform, absorbing the shock of the impact before depression 16 in base insert 30 is contacted. Similarly, depression 22 in top insert 34 is spaced from sidewalls 36 and top wall 46 of top 32 so that if the sidewalls or top wall of the top become impacted, the sidewalls and top wall can become deformed, absorbing the impact of the shock before depression 22 in top insert 34 is contacted. For the same reasons it is desirable that depressions 16 in base insert 30 be spaced from the partitioning means in base 28 when base 28 is provided with such partitioning means, and for the depressions 22 in top insert 34 to be spaced from the partitioning means in top 32 when top 32 is provided with such partitioning means.

The packaging device is generally provided with a locking means e.g., one or more locks or latches for holding base insert 30 in base 28, for holding top insert 34 in top 32 and for holding the cover portion of the packaging device on the bottom of the packaging device. In the preferred embodiment the locking means comprises a protrusion 64 which extends upwardly from bottom wall 42 which protrusion is provided with a male member 66 for engagement with a female member 68 located on a protrusion 70 which extends downwardly from its top wall 46 of top 32. Base insert 30 is provided with a hole 72 to permit access to male member 66 through lower wall 44 and top insert 34 is provided with a hole 74 to permit access to female member 68 through upper wall 54. Holes 72 and 74 may be sized to fit tightly over or snap over male member 66 and female member 68 respectively.

We claim:

1. An integral packaging device for fragile articles comprising a base, a top, a base insert, and a top insert each of which is individually defined by its own sidewalls, each of said sidewalls having top and bottom edges, said base being further defined by a bottom wall connected to the bottom edges of the sidewalls of the base, and having partitioning means therein, said top being further defined by a top wall connected to the top edges of the sidewalls of the top, the bottom edge of one of the sidewalls of the top being connected by a hinge to the top edge of one of the sidewalls of the base, said base insert including a lower wall connected to the sidewalls of the base insert, said lower wall being provided with a plurality of downwardly extending depressions each having an interior which is approximately the size of a lower portion of a fragile article for containing said lower portion, said base insert being hinged at the top edge of one of its sidewalls to the top edge of a sidewall of the base other than the top edge of the sidewall of the base hinged to the top, said base insert being sized to sit tightly into the base with said depressions being separated by said partitioning means of the base, said top insert including an upper wall connected to the sidewalls of the top insert, said upper wall being provided with a plurality of upwardly extending depressions to match the depressions in the base insert, each depression having the approximately the size of an upper portion of a fragile article for containing said upper portion, said top insert being hinged at the bottom edge of one of its sidewalls to the bottom edge of its sidewall of the top other than the bottom edge of the sidewall of the top hinged to the base, said top insert being sized to fit tightly into the top, said packaging device being nestable into a similar packaging device when the upper edges of the sidewalls of the base and base insert, and the bottom edges of the top and top insert of the packaging device are in approximately parallel plains, the base insert is not fitted into the base and the top insert is not fitted into the top.

2. The packaging device of claim 1 wherein the top is provided with a partitioning means for separating the depressions in the top insert when the top insert is fitted into the top.

3. The packaging device of claim 2 wherein the depressions in the top insert are spaced from the sidewalls, the top wall and the partitioning means of the top when the top insert is fitted into the top.

4. The packaging device of claim 1 wherein the depressions in the base insert are spaced from the sidewalls, the bottom wall and the partitioning means of the base when the base insert is fitted into the base.

5. The packaging device of claim 1 wherein the base has a volumn greater than the fragile articles and the downwardly expanding depressions are provided with a hole connecting the interior of the downwardly extending depressions with the base.

* * * * *